US006926146B2

(12) United States Patent
Gheblikian

(10) Patent No.: US 6,926,146 B2
(45) **Date of Patent: *Aug. 9, 2005**

(54) SMALL COMPONENT PARTS FILING AND INVENTORY CONTROL SYSTEM

(76) Inventor: Joseph A. Gheblikian, 10660 Branham Fields Rd., Duluth, GA (US) 30097

( * ) Notice: Subject to any disclaimer, the term of this patent is extended or adjusted under 35 U.S.C. 154(b) by 60 days.

This patent is subject to a terminal disclaimer.

(21) Appl. No.: 10/427,086

(22) Filed: Apr. 30, 2003

(65) Prior Publication Data

US 2003/0192804 A1 Oct. 16, 2003

Related U.S. Application Data

(63) Continuation-in-part of application No. 09/686,302, filed on Oct. 11, 2000, now Pat. No. 6,581,770.
(60) Provisional application No. 60/158,899, filed on Oct. 12, 1999.

(51) Int. Cl.[7] ..... B65D 85/00
(52) U.S. Cl. ..... 206/425; 224/219
(58) Field of Search ..... 206/6.1, 232, 425, 206/449, 459.5, 554, 526, 574; 40/360, 405; 211/50, 53, 55, 56, 58; 224/219, 221, 277; 383/9

(56) References Cited

U.S. PATENT DOCUMENTS

| | | | | |
|---|---|---|---|---|
| 2,677,276 A | | 5/1954 | Brunner | |
| 3,260,006 A | | 7/1966 | Dunajew | |
| 4,258,914 A | * | 3/1981 | Lalli | 224/219 |
| 4,483,018 A | | 11/1984 | Whelan | |
| 4,602,447 A | | 7/1986 | Feingold | |
| 4,706,996 A | | 11/1987 | Fasham | |
| 4,708,243 A | | 11/1987 | Nailon | |
| 4,765,653 A | | 8/1988 | Fasham et al. | |
| 4,811,845 A | | 3/1989 | Baggett | |
| 4,966,318 A | | 10/1990 | Dutka | |
| 4,973,086 A | | 11/1990 | Donnelly et al. | |
| 5,018,897 A | | 5/1991 | Horgan | |
| 5,123,197 A | | 6/1992 | Gentry et al. | |
| 5,123,676 A | | 6/1992 | Donnelly et al. | |
| 5,204,449 A | * | 4/1993 | Puri | 224/219 |
| 5,251,744 A | | 10/1993 | Dziersk et al. | |
| 5,305,935 A | | 4/1994 | Weiner | |
| 5,307,926 A | | 5/1994 | Mee | |
| 5,394,638 A | | 3/1995 | Raymond et al. | |
| 5,555,977 A | | 9/1996 | Oshry et al. | |
| 5,632,113 A | | 5/1997 | Raymond et al. | |
| 5,682,730 A | | 11/1997 | Dobreski | |
| 5,960,957 A | | 10/1999 | Johnson | |
| 6,581,770 B1 | | 6/2003 | Gheblikian | |

* cited by examiner

*Primary Examiner*—Luan K. Bui
(74) *Attorney, Agent, or Firm*—Barry E. Kaplan; Ashish D. Patel; Myers & Kaplan, LLC

(57) ABSTRACT

A small component parts filing and inventory control system including a repeatedly resealable bag for containing small parts, the bag further including a mounting portion extending from the bag. The mounting portion is isolated from the bag cavity so that parts may not pass therethrough. The mounting portion enables the removable mounting, and the slidable repositioning, of the bag upon a rail or system of rails. The bag further may include an information bearing portion related to the parts contained within the bag, the information bearing portion showing information such as, but not limited to, two or more of manufacturer, manufacturer contact information, part description, catalog number, part identifying number, date of purchase, cost at purchase, quantity at purchase, quality, size, bar code identifier, color code identifier, or the like. Also provided are advantageous alternate constructions of the bag and of a rail system, including a novel base.

18 Claims, 3 Drawing Sheets

SMALL COMPONENT PARTS FILING AND INVENTORY CONTROL SYSTEM

RELATED APPLICATIONS

The inventor hereof claims priority based upon and pursuant to the U.S. nonprovisional patent application having Ser. No. 09/686,302 filed on Oct. 11, 2000, and now issued as U.S. Pat. No. 6,581,770 B1, with an issue date of Jun. 24, 2003, and to U.S. provisional patent application having Ser. No. 60/158,899 filed on Oct. 12, 1999.

TECHNICAL FIELD

The present invention relates generally to a small component parts filing and inventory control system; and, more specifically, to a system enabling the filing, storing, inventorying, and transporting of small component parts, along with certain critical identifying information related thereto.

BACKGROUND OF THE INVENTION

In the jewelry industry, many small, yet valuable, parts are routinely handled during the design, preparation, fabrication, or repair of a piece of jewelry. In such an environment, small pieces easily may be lost, misplaced, or misidentified, imposing significant time losses, and sometimes financial losses, upon the jeweler.

Often in such an environment, there is no convenient means both to store the part, alongside of other equivalent or related parts, and, optionally, to easily ascertain critical information about the part, such as might be needed concerning its identification, inventory status, or reordering information. Examples of such critical information may take the form of the identification of the manufacturer of a particular part, the contact information for the manufacturer, its part number, part description, catalog reference, catalog number, date of purchase, cost at purchase, quantity at purchase, quality, size, bar code identifier, or the like.

Similarly, there often is no convenient system offering flexibility for the organization, and subsequent reorganization, of the part, alongside of other equivalent or related parts, and, optionally, offering the ability to keep at hand the critical information related to the part or parts. In such an environment, it would be advantageous to provide a system that would accommodate differing needs of various users over time. Furthermore, it would be advantageous to provide for the safe transportability of the system between and among a security safe, workbench, countertop, or the like.

Such a system might advantageously be utilized within fields of endeavor other than jewelry, as, for example, in such fields wherein there is a need to organize, store, access, identify, and safely transport small parts. Such fields might include those that use small electrical or electronic components, mechanical hardware, or the like.

In recognition of certain of the above-stated organizational needs, U.S. Pat. No. 5,123,197 to Gentry et al. provides a fishing bait organizer including a flat backing member, along with a series of attaching members for the securing of groups of storage bags to the backing member. The mouths of the storage bags open away from the backing member. Into the bags may be placed various fishing baits and lures. Disadvantageously, this organizer does not provide means for easily separating each bag from the organizer or for optionally ascertaining critical information regarding the contents of the bag; nor does it provide sufficient structural support for the orientation of the mouths of the bags toward the user and the maintenance of the bags in that position; nor does it provide for the convenient reorganization of the individual bags during use of the organizer. Similar observations may be had with reference to the fishing bait and tackle organizers of U.S. Pat. Nos. 5,394,638 and 5,632,113, both to Raymond et al., and to the plastic bag organizer and storage apparatus of U.S. Pat. No. 5,960,957 to Johnson.

U.S. Pat. No. 5,305,935 to Weiner provides a portable coupon organizer that may be attached to the handle of a shopping cart by rings. This organizer provides a series of transparent, sealable pockets for the storage of coupons. The user may view coupons from either side of the pocket. Although each pocket may be labeled according to the user's preference for the organization of the coupons contained therein, the referenced patent does not teach the use or need to optionally associate with each pocket such other critical information as is needed in a component parts storage system. As with the previously referenced prior art patent, the organizer of the referenced patent does not provide means for easily separating each bag from the organizer rings; nor does it provide sufficient structural support for the orientation of the mouths of the bags toward the user and the maintenance of the bags in that position.

In accordance, then, with the needs recognized hereinabove, and the stated short-comings of the referenced prior art devices toward such needs, an effective small component parts filing and inventory control system would prove advantageous for persons engaged, generally, in the stocking, inventorying, using, and transporting of small parts in association with a manufacturing or repair facility. It is to the provision of such a system that the present invention is directed.

BRIEF SUMMARY OF THE INVENTION

Briefly described, in a preferred embodiment, the present invention both overcomes the above-mentioned disadvantages, and meets the recognized needs for such device, by providing a small component parts filing and inventory control system including a repeatedly resealable bag for containing small parts, the bag further including mounting means extending therefrom, the mounting means being isolated from the bag cavity so that parts may not pass therethrough. The mounting means enables the removable mounting, and the slidable repositioning, of the bag upon a rail or system of rails. The bag further may comprise an information bearing portion related to the parts contained within the bag, the information bearing portion showing information such as, but not limited to, two or more of manufacturer, manufacturer contact information, part description, catalog number, part identifying number, date of purchase, cost at purchase, quantity at purchase, quality, size, bar code identifier, or color code identifier.

According to an alternate embodiment of the bag of the present invention, the information bearing portion advantageously may be used to affix the mounting means to the bag.

According to an alternate construction of the present invention, provided is a rail system mounted upon a base having a saddle-shaped surface traversing the length thereof. In this form, the base conveniently may rest upon a curved surface, such as a leg or an arm of the user, enabling prompt and efficient access to the system of the present invention, along with the component parts and information contained therein.

According to another alternate construction of the present invention, provided is a rail system in circular form, mounted upon a base and optionally having a saddle-shaped surface traversing thereacross.

Thus, an object, feature, and advantage of the present invention is the provision of a new and improved small component parts filing and inventory control system that allows the convenient storage and identification of, and access to, small component parts.

Another object, feature, and advantage of the present invention is the provision of a new and improved small component parts filing and inventory control system that provides means both to store small component parts, alongside of other equivalent or related parts, and to easily ascertain critical information about the parts, such as might be needed concerning its identification, inventory status, or reordering information.

Yet another object, feature, and advantage of the present invention is the provision of a new and improved small component parts filing and inventory control system that may provide critical information in the form of the identification of the manufacturer of a particular part, the contact information for the manufacturer, its part number, part description, catalog reference, catalog number, date of purchase, cost at purchase, quantity at purchase, quality, size, bar code identifier, color code identifier, or the like.

Still another object, feature, and advantage of the present invention is the provision of a new and improved small component parts filing and inventory control system offering flexibility for the organization, and subsequent reorganization, of parts, alongside of other equivalent or related parts, and offering the ability to keep at-hand the critical information related to the part or parts.

Yet still another object, feature, and advantage of the present invention is the provision of a new and improved small component parts filing and inventory control system that provides for the safe transportability of the system between and among a security safe, workbench, countertop, or the like.

Another and further object, feature, and advantage of the present invention is the provision of a new and improved small component parts filing and inventory control system that may advantageously be utilized within different fields of endeavor wherein there is a need to organize, store, access, identify, and safely transport small parts.

Still another and further object, feature, and advantage of the present invention is the provision of a new and improved small component parts filing and inventory control system that will accommodate reorganization at the user's discretion and convenience according to form, requirement, or function; or that, alternatively, will accommodate specific user-defined cataloging systems.

Accordingly, other objects, features, advantages, and characteristics of the present invention, as well as the methods of operation, construction, and function of the related elements and structure will become more apparent upon consideration of the following description and the appended claims, with reference to the accompanying drawing Figures, all of which form a part of this specification.

BRIEF DESCRIPTION OF THE FIGURES

The present invention will be better understood by reading the Detailed Description of the Preferred Embodiment with reference to the accompanying drawing figures, in which like reference numerals denote similar structure and refer to like elements throughout, and in which.

DETAILED DESCRIPTION OF THE PREFERRED EMBODIMENT

In describing the preferred and alternate embodiments of the present invention illustrated in the Figures, specific terminology is employed for the sake of clarity. The invention, however, is not intended to be limited to the specific terminology so selected, and it is to be understood that each specific element includes all technical equivalents that operate in a similar manner to accomplish a similar purpose.

Figure 1:
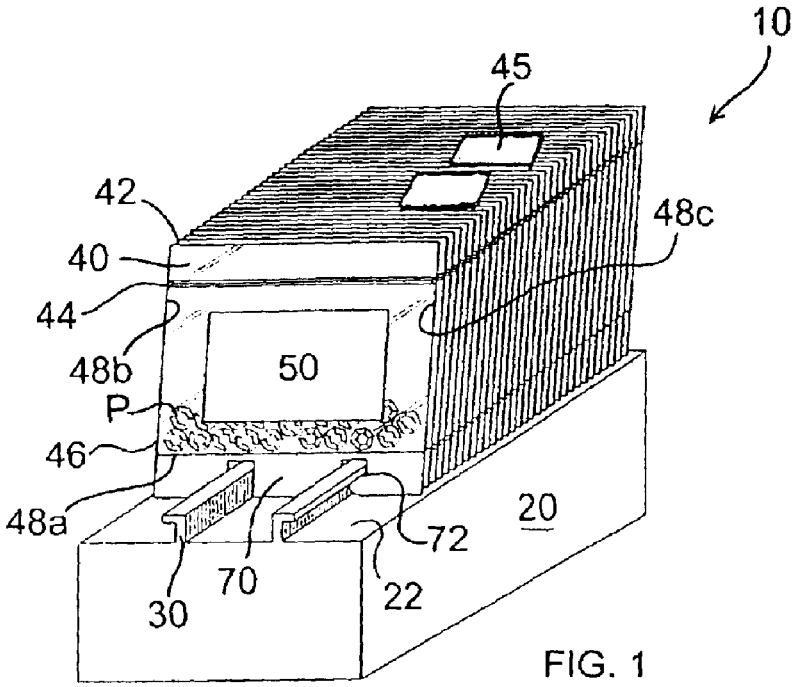
FIG. 1 is a perspective view of the small component parts filing and inventory control system of the present invention.
Figure 2:
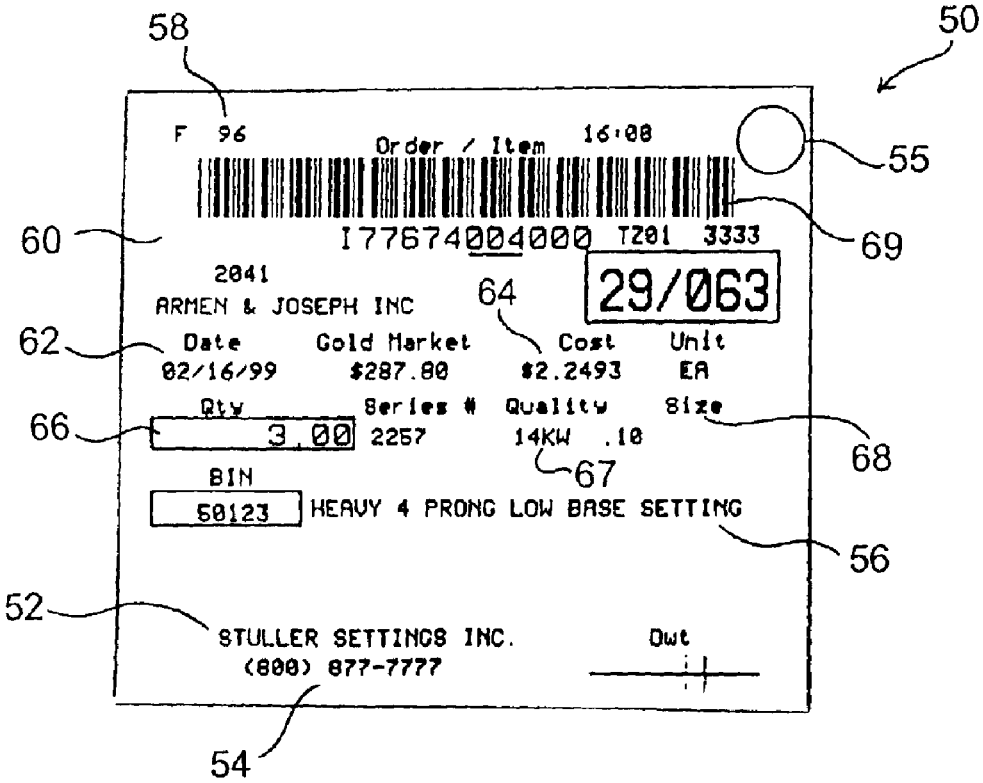
FIG. 2 is a plan view of the information bearing portion of the small component parts filing and inventory control system of the present invention.

In accordance then with the goals, needs, objectives, and advantages recognized hereinabove, FIG. 1 depicts a preferred embodiment of the small component parts filing and inventory control system 10 of the present invention. Broadly stated, the system of the present invention comprises base 20, base 20 preferably having a pair of rails 30 attached thereto, and resealable bag 40 that may be removably mountable upon rails 30, bag 40 further optionally carrying information bearing portion 50. Representative details of information bearing portion 50 may be seen best with reference to FIG. 2.

With continued reference to FIG. 1, attached to base 20 upon surface 22 preferably are a pair of spaced-apart, L-shaped rails 30. Rails 30 are spaced and sized so as to cooperatively engage bag 40, in the manner further described below. It will be recognized that surface 22 may be inclined, curved, or otherwise disposed in conjunction with base 20 for the ease of use of system 10, the proper orientation and disposition of bag 40, and the convenience of the user.

Bag 40 preferably is a plastic bag of repeatedly resealable construction, well-known in the art. In accordance with such construction, cooperating male and female rib members, shown in mated configuration in FIG. 1 at reference numeral 44, are disposed on opposite, facing panels of bag 40, adjacent the opening edges 42 thereof. When the ribs are so engaged, the edges 42 of the facing panels of bag 40 remain free to enable subsequent separation of the ribs and, thereby, reopening of the bag. Although cooperating male and female rib members are utilized to permit the repeatable opening and resealing of bag 40, it is contemplated in an alternate embodiment that other suitable mechanisms could be utilized, such as, for exemplary purposes only, zippers, hook-and-loop fasteners, cooperating male and female rib members having a zipper pull, resealable adhesives, resealable double-sided tape, snap-buttons, tension bands, elastic mechanisms, prong-and-grommet mechanisms, and/or closure flaps having any of the afore-referenced mechanisms.

In accordance with standard bag construction methods, opposing the edges 42 is second end 46 bearing seam 48*a*.

Seam 48*a* permanently joins together the facing panels of bag 40 at its end 46. Similarly sealed are edges 48*b* and 48*c*. In this fashion, the interior of the panels so joined define an interior cavity.

Bag 40 is sized to accommodate within its interior small component parts P. Although system 10 preferably carries a plurality of bags 40, it will be appreciated that similarly sized bags 40 are preferred for ease of alignment and use within system 10.

Extending from bag 40 is mounting portion 70 carrying therewithin openings 72. In the preferred embodiment, openings 72 are a pair of T or L-shaped slots formed equidistantly from the center of bag 40, sized and spaced to removably and slidably interface with rails 30. It will be recognized that the interior of bag 40 is isolated from openings 72 via seam 48*a* in order that parts P do not fall through the openings.

It will now be recognized by one ordinarily skilled in the art that the preferred combination of L-shaped rails 30 and T or L-shaped openings 72 together comprise a commonly available and often-utilized system for index card storage. Such systems are readily available under the brand name, ROLODEX®. Such systems are advantageous to the present invention in that an individual bag 40 may easily be removed from, and reattached to, the rail with minimal effort, and further may be slid along the rails in order to space one bag apart from an adjacent bag. While such a system is advantageous to the present invention, and forms a part of the present invention, its use is not required; nor should the present invention be read to be limited thereto. Rather, other systems may prove equally advantageous, depending upon the requirements of the user.

For example, it will be appreciated that other types and/or shapes of rails 30 might be utilized; e.g., those of round, oval, or rectangular cross-section, T-rails, straight rails, curvilinear rails, flat rails, tubular rails, rails for ball-and-track mechanisms, rails for wheel-and-track mechanisms, rails for slider-and-track mechanisms, rails having ball-bearing mechanisms, rails adapted for use in grommet-and-loop mechanisms, rails for snap-on-and-slide mechanisms, binder rings, half-rounds, full-rounds and guide rails. Similarly, rails 30 might be separated by spacers or standoffs from surface 22. With the use of such rail configurations, openings 72 would be selected, spaced, and positioned within mounting portion 70 so as to cooperate with the selected rail configuration. Alternatively, to effectuate implementation of the ball-and-track mechanisms, wheel-and-track mechanisms, slider-and-track mechanisms, ball-bearing mechanisms, grommet-and-loop mechanisms, snap-on-and-slide mechanisms, or the like, mounting portion 70 can possess the requisite adapters or interface for functional engagement therewith. Should more permanent affixation of bag 40 to rails 30 be required, openings 72 might advantageously be spaced away from the edge of mounting portion 70, with a margin therebetween. For such openings 72, a point of access would typically be provided within the rails 30.

A convenient option within system 10 is information bearing portion 50. The details of information bearing portion 50 may best be seen with reference to FIG. 2. Although information bearing portion 50 may be placed inside or outside of bag 40, it is preferably placed upon the outside so that its informational content is not obscured by parts P. Information bearing portion 50 preferably takes the form of an adhesive-backed label, the type of adhesive being selected to enable the convenient removal of the label from bag 40 without tearing either the label or the bag. The reason for such a feature is discussed more fully below. Alternatively, information bearing portion 50 may be printed or otherwise permanently placed on bag 40.

Information bearing portion 50 serves to bear such critical component part identifying information as the user should require, but preferably two or more of manufacturer 52, manufacturer contact information 54, part description 56, catalog number 58, customer identifier 60, date of purchase 62, cost at purchase 64, quantity at purchase 66, quality 67, size 68, bar code identifier 69, or the like. Color coded element 55 additionally may be provided for the user's convenience and benefit. It is contemplated in an alternate embodiment that information bearing portion 50 could further comprise the style number of the component part and/or a picture of the component part.

In accordance with system 10, the benefits of having such critical identification information near at-hand will be apparent. Such a system aids in the speedy location of small parts for subsequent whole-inventory accounting functions. It further aids in the speedy location of manufacturer and manufacturer contact information for reordering, and provides, at-hand, all such information as the user should require for placing a reorder. Furthermore, system 10 provides the user with the convenient ability to organize similar parts from different manufacturers, or to organize similar parts having different costs-at-purchase. Such a system further provides the user with the convenient ability to group related, but different, parts in near proximity for ease of identification, access, and use. Individual bags 40 may be reorganized at the user's discretion and convenience according to form, requirement, or function; or, alternatively, specific user-defined cataloging systems can be established or accommodated. Such features of system 10 of the present invention provide clear advantages over the prior art previously discussed.

It will be appreciated that, in accordance with the preferably removable nature of information bearing portion 50, the direction of the information bearing portion 50 may be inverted, or otherwise oriented, for overhead-type or alternate uses of system 10, as in such applications requiring base 20 to be mounted in inverted configuration such that bags 40 hang downwardly. By inverting the information bearing portion 50, the information thereupon conveniently may be read, so that bag 40 may be temporarily removed from rails 30 to provide convenient access to the parts. In such configuration, it will also be appreciated by one ordinarily skilled in the art that mounting portion 70 advantageously may be located proximate to edges 42, rather than proximate to seam 48*a*.

System 10 optionally may be further provided with dividers 45. Dividers 45 may be provided with a variety of optional characteristics to enhance the value of system 10. For example, dividers 45 may correspond to sections within a manufacturer's catalog, and may further bear a representative miniature copy of the corresponding index to the manufacturer's catalog section, or may bear a representative miniature copy of the manufacturer's catalog section divider itself. Dividers 45 may be color coded to correspond to the manufacturer's color coding and tab sequence.

Behind each divider 45 might be placed individual bags 40, each such bag further representing a page or other convenient subdivision within the manufacturer's catalog. The system 10, so equipped with dividers 45, essentially enables the user to create a "live" manufacturer's "catalog," wherein actual parts P are represented on corresponding "pages" within corresponding sections of the "catalog." In this manner, the system provides actual parts P within the "catalog," rather than mere photographs thereof.

Figure 3:
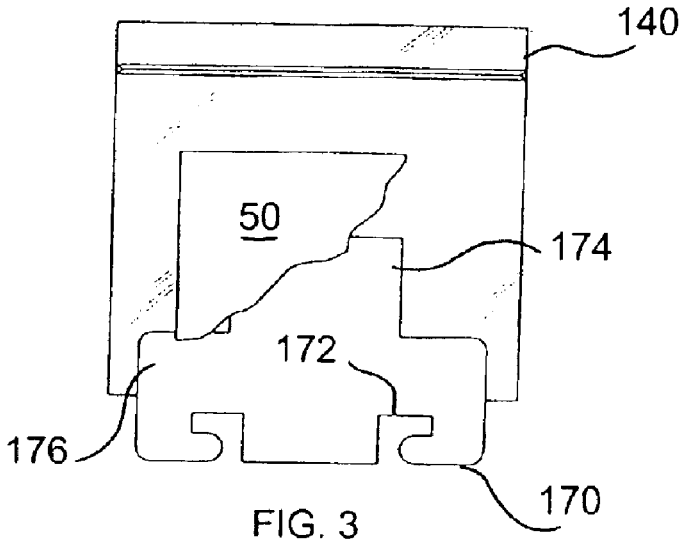
FIG. 3 is a plan view of a portion of the small component parts filing and inventory control system of the present invention, wherein is demonstrated one means of affixing the mounting means to a bag through the use of an information bearing portion in the form of an adhesive-backed label.

Turning now to FIG. 3, provided is an embodiment of the bag of the present invention according to an alternate construction. Bag 140 demonstrates equivalent characteristics to those previously described in relation to bag 40, varying primarily as follows. In lieu of bag 40 with integrally manufactured mounting portion 70, bag 140 is affixed to its mounting portion 170 through the use of the information bearing portion 50. Such an affixation arrangement is best enabled when the information bearing portion 50 takes the form of an adhesive-backed label, as previously described. In the embodiment of mounting portion 170 shown in FIG. 3, tab 174 extends from the section of mounting portion 170 which bears openings 172.

Of course, while tab 174 is convenient, its presence and use is not required for the effective alternate construction of bag 140 with separate mounting portion 170. It will be similarly appreciated that mounting portion 170 conveniently may be inverted according to this construction so that it is located proximate to the opening end of bag 140. As previously described, this configuration may prove convenient for use in overhead mounting arrangements.

Figure 4:
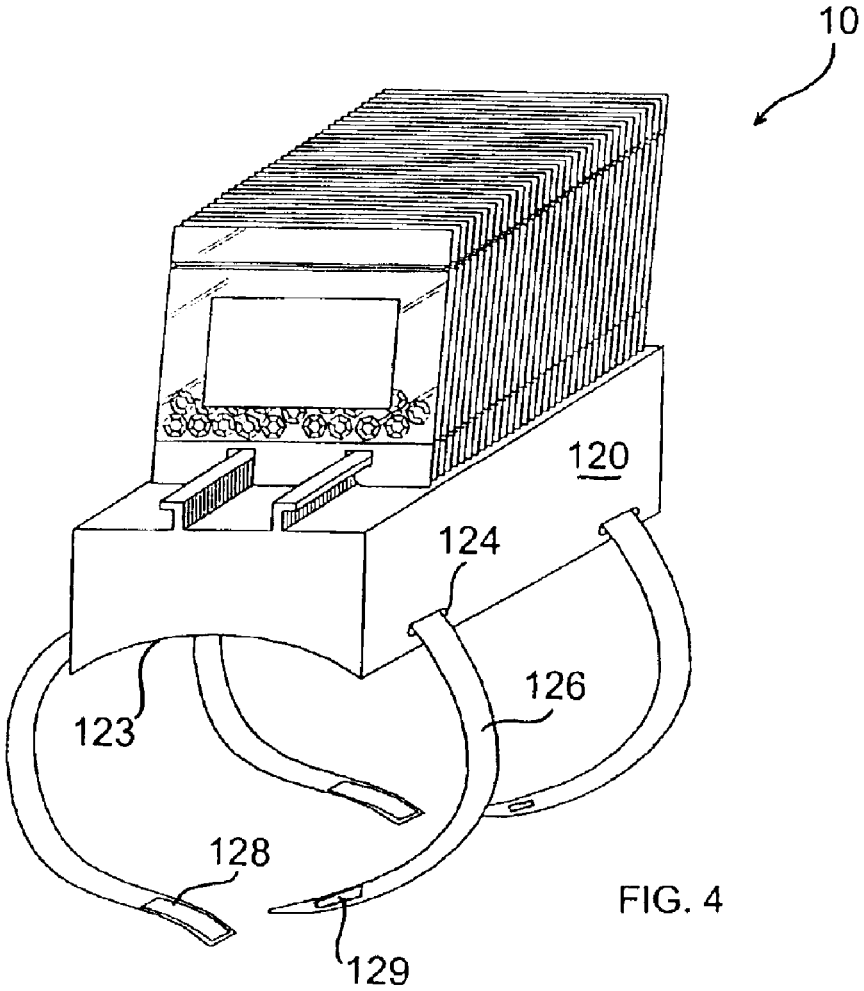
FIG. 4 is a perspective view of an alternate embodiment of the small component parts filing and inventory control system of the present invention; and, FIG. 5 is a perspective view of another alternate embodiment of the small component parts filing and inventory control system of the present invention.

Turning next to FIG. 4, there is shown an alternate construction for the base of system 10. In such alternate construction, the details of system 10 remain equivalent to those previously described, varying primarily as follows. Base 120 is provided with a saddle-shaped surface traversing its length. Slots 124 are provided to support and constrain straps 126 therewithin. Straps 126 may be provided with cooperating fastening elements, demonstrated in FIG. 4 as hook portion 128 and loop portion 129, for joining of the respective strap ends. Advantageously, base 120, as shown and described, conveniently may rest upon a curved surface, such as a leg or an arm of the user, enabling prompt and efficient access to system 10, along with the component parts and information contained therein.

Of course, it will be appreciated that other conventional cooperating fastening elements might advantageously be utilized. Such systems might comprise buckle elements, pin and hole elements, snap closures, or the like, without limitation. Alternatively, straps 126 may advantageously take the form of inwardly biased, flexible clamping elements of such forms as are well-known in the art.

Figure 5:
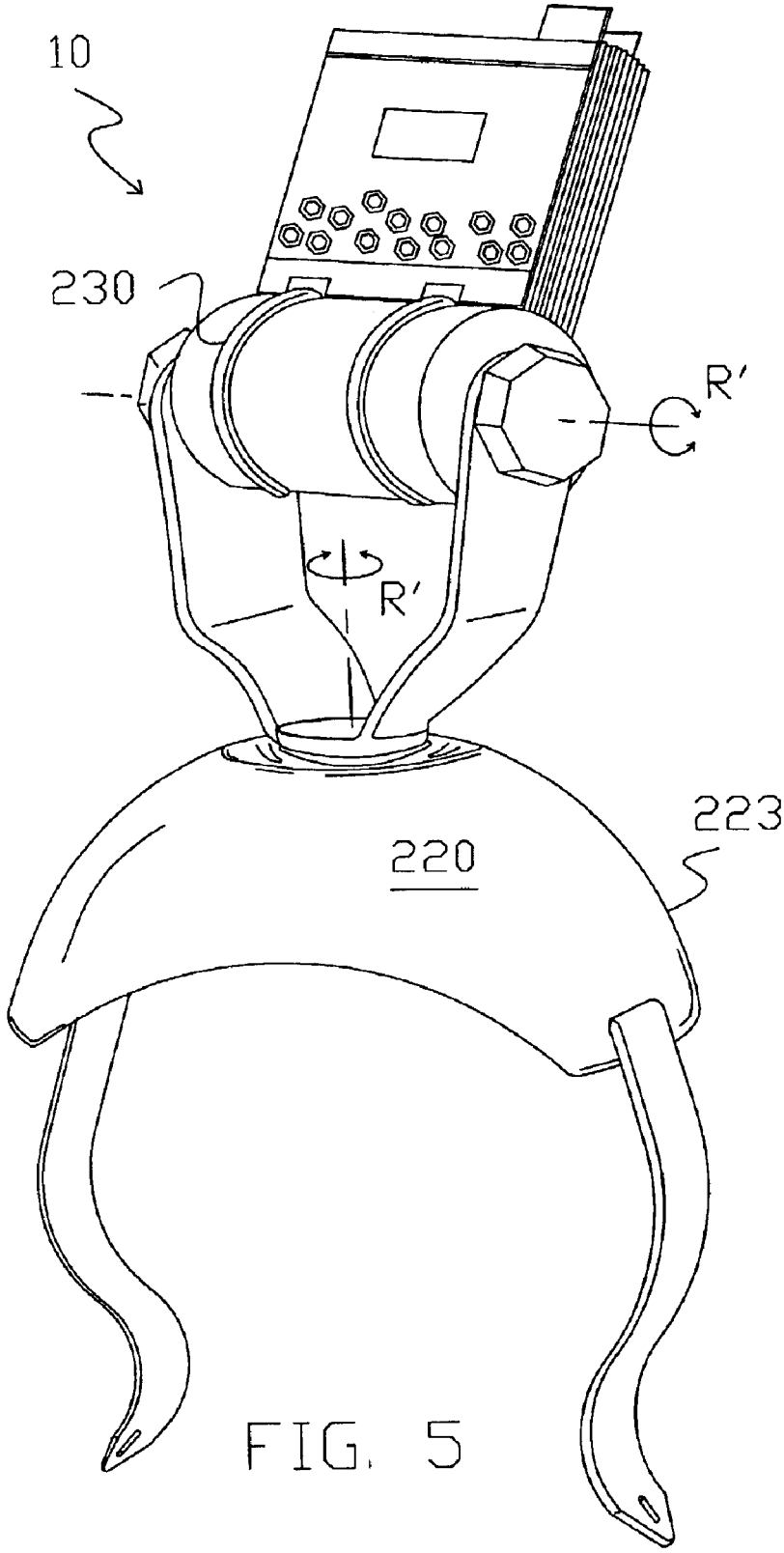

Finally, turning to FIG. 5, shown is another alternate construction of the present invention, providing the rail system 230 in circular form, mounted upon a base 220, and optionally having a saddle-shaped surface 223 traversing thereacross. In such alternate construction, the details of system 10 remain equivalent to those previously described, varying primarily as described. Advantageously, this construction provides compactness in the overall system. The base may be provided so that it rotates to any orientation desired by the user, as about axes R' and R".

Accordingly, the present invention is now seen to be advantageous for persons engaged in the stocking, inventorying, using, and transporting of small parts in association with a manufacturing or repair facility, wherein many small, often valuable, parts are routinely handled during processes of design, preparation, fabrication, or repair. In such environments, the present invention will be seen advantageously to prevent small pieces from being lost, misplaced, or misidentified; thereby, saving the user from significant time and financial losses attendant to the use of prior art systems. Through the use of the present invention, critical information concerning the part, such as its identification, inventory status, and reordering information, may be stored along with the component part, enhancing the use and value of the invention. Similarly, the present invention provides flexibility for organization, and subsequent reorganization, of the part, along with other equivalent or related parts, and provides for the safe transportability of the system between and among a safe, workbench, countertop, or the like.

With regard, then, to all such embodiments as may be herein described and contemplated, it will be appreciated that optional features, such as color coding of the component bags or of the identifying information contained thereon, varied methods of mounting the base or of mounting the bags to the base, or the like, may be provided in association with the present invention, all without departing from the scope of the invention.

Having thus described preferred embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

I claim:

1. A small component parts filing and inventory control system comprising:

a bag comprising a first end, a second end, and two sides, said ends and sides comprising a cavity therebetween;

said bag further comprising a mounting means extending from either said first end or said second end, said bag mounting means being isolated from said bag cavity;

said bag mounting means formed as a separate component from said bag and thereafter affixed to said bag;

said bag mounting means enabling the removable mounting, and the slidable repositioning, of said bag upon a rail;

said bag further comprising a repeatedly resealable opening adjacent said second end; and, a base, said base comprising means for removably mounting said base to a selected surface, wherein said bag further comprises an information bearing portion comprising two or more of manufacturer, manufacturer contact information, part description, catalog number, style number, part picture, customer identifier, date of purchase, cost at purchase, quantity at purchase, quality, size, bar code identifier, or color code identifier.

2. The small component parts filing and inventory control system of claim 1 wherein said bag mounting means comprises a portion bearing an opening disposed adjacent an edge of said bag mounting means.

3. The small component parts filing and inventory control system of claim 1 wherein said bag mounting means comprises a portion bearing a hole near an edge of said bag mounting means.

4. The small component parts filing and inventory control system of claim 1 wherein said bag mounting means comprises a portion bearing an opening of non-circular shape adjacent or near an edge of said bag mounting means.

5. The small component parts filing and inventory control system of claim 1 wherein said base carries said rail.

6. The small component parts filing and inventory control system of claim 1 wherein said bag mounting means comprises the requisite interface to be removably and slidably adapted to said rail, and wherein said rail is selected from the group consisting of rails having a round cross-section, rails having an oval cross-section, rails having a rectangular cross-section, T-rails, L-rails, straight rails, curvilinear rails, flat rails, tubular rails, rails for ball-and-track mechanisms, rails for wheel-and-track mechanisms, rails for slider-and-track mechanisms, rails having ball-bearing mechanisms, rails adapted for use in grommet-and-loop mechanisms, rails for snap-on-and-slide mechanisms, binder rings, half-rounds, full-rounds and guide rails.

7. The small component parts filing and inventory control system of claim 1 wherein said base further comprises a saddle-shaped portion enabling said base to rest upon a curvilinear surface.

8. The small component parts filing and inventory control system of claim 1 wherein said removable mounting means of said base is selected from the group consisting of straps, cooperating hook-and-loop fasteners, and combinations thereof.

9. A system for providing rapid access to small component parts and information related thereto comprising in combination:

a base comprising a rail, wherein said base further comprises means for removably mounting said base to a selected surface;

a bag comprising a first end, a second end, and two sides, said ends and sides comprising a cavity therebetween;

said bag further comprising a bag mounting means extending from either said first end or said second end, said bag mounting means being isolated from said bag cavity, said bag mounting means formed as a separate component from said bag and thereafter affixed to said bag; said bag mounting means enabling the removable mounting, and the slidable repositioning, of said bag upon said rail;

said bag further comprising a repeatedly resealable opening adjacent said second end.

10. The combination of claim 9 wherein said bag mounting means comprises a portion bearing an opening disposed adjacent an edge of said bag mounting means.

11. The combination of claim 9 wherein said bag mounting means comprises a portion bearing a hole near an edge of said bag mounting means.

12. The combination of claim 9 wherein said bag mounting means comprises a portion bearing an opening of non-circular shape adjacent or near an edge of said bag mounting means.

13. The combination of claim 9 wherein said removable mounting means of said base comprises a saddle-shaped portion enabling said base to rest upon a curvilinear surface.

14. The combination of claim 9 wherein said removable mounting means of said base is selected from the group consisting of straps, cooperating hook-and-loop fasteners, and combinations thereof.

15. The combination of claim 9 wherein said bag mounting means comprises the requisite interface to be removably and slidably adapted to said rail, and wherein said rail is selected from the group consisting of rails having a round cross-section, rails having an oval cross-section, rails having a rectangular cross-section, T-rails, L-rails, straight rails, curvilinear rails, flat rails, tubular rails, rails for ball-and-track mechanisms, rails for wheel-and-track mechanisms, rails for slider-and-track mechanisms, rails having ball-bearing mechanisms, rails adapted for use in grommet-and-loop mechanisms, rails for snap-on-and-slide mechanisms, binder rings, half-rounds, full-rounds and guide rails.

16. A system for providing rapid access to small component parts and information related thereto comprising a base comprising a rail, wherein said base further comprises means for removably mounting said base to a selected surface; a bag comprising a first end, a second end, and two sides, said ends and sides comprising a cavity therebetween; said bag further comprising an opening-bearing portion extending from either said first end or said second end, said opening-bearing portion being isolated from said bag cavity, said opening-bearing portion formed as a separate component from said bag and thereafter affixed to said bag, said opening-bearing portion enabling the removable mounting, and the slidable repositioning, of said bag upon said rail; and, said bag further comprising a repeatedly resealable opening adjacent said second end.

17. The system of claim 16 wherein said removable mounting means of said base is selected from the group consisting of a saddle-shaped portion enabling said base to rest upon a curvilinear surface, straps, cooperating hook-and-loop fasteners, and combinations thereof.

18. The system of claim 16 wherein said opening-bearing portion comprises the requisite interface to be removably and slidably adapted to said rail, and herein said rail is selected from the group consisting of rails having a round cross-section, rails having an oval cross-section, rails having a rectangular cross-section, T-rails, L-rails, straight rails, curvilinear rails, flat rails, tubular rails, rails for ball-and-track mechanisms, rails for wheel-and-track mechanisms, rails for slider-and-rack mechanisms, rails having ball-bearing mechanisms, rails adapted for use in grommet-and-loop mechanisms, rails for snap-on-and-slide mechanisms, binder rings, half-rounds, full-rounds and guide rails.

* * * * *